United States Patent [19]

Gurrola

[11] 3,994,104

[45] Nov. 30, 1976

[54] SUPPORTED ROOF STRUCTURE

[76] Inventor: Hector R. Gurrola, 6506 Ben Ave., North Hollywood, Calif. 91606

[22] Filed: Mar. 30, 1976

[21] Appl. No.: 671,748

[52] U.S. Cl. ..... 52/90; 52/78; 52/22

[51] Int. Cl.[2] ..... C04B 7/02

[58] Field of Search ..... 52/90, 93, 74–78, 52/473, 507, DIG. 8, 511

[56] References Cited

UNITED STATES PATENTS

| | | | |
|---|---|---|---|
| 3,084,479 | 4/1963 | Struben | 52/90 |
| 3,100,012 | 8/1963 | Dunn | 52/74 |
| 3,113,434 | 12/1963 | Phillips | 52/90 |
| 3,161,924 | 12/1964 | Noecker | 52/78 |
| 3,228,152 | 1/1966 | Wilbourn | 52/78 |
| 3,286,404 | 11/1966 | Harrison | 52/90 |
| 3,300,940 | 1/1967 | Golasz | 52/DIG. 8 |
| 3,332,179 | 7/1967 | Toti | 52/90 |
| 3,388,510 | 6/1968 | Smith | 52/74 |
| 3,470,666 | 10/1969 | Mod | 52/DIG. 8 |
| 3,932,968 | 1/1976 | Heirich | 52/74 |

FOREIGN PATENTS OR APPLICATIONS

| | | | |
|---|---|---|---|
| 239,834 | 7/1962 | Australia | 52/74 |
| 836,805 | 3/1970 | Canada | 52/90 |
| 1,384,726 | 11/1964 | France | 52/22 |
| 2,109,514 | 9/1972 | Germany | 52/74 |
| 2,411,956 | 8/1975 | Germany | 52/90 |

*Primary Examiner*—Price C. Faw, Jr.
*Assistant Examiner*—Henry Raduazo
*Attorney, Agent, or Firm*—Wm. Jacquet Gribble

[57] ABSTRACT

Rolled or extruded box beams and rafters are supported from an existing wall or other structure with the aid of added posts. The beams and rafters extend trasversely to each other, the rafters being secured at the wall by an anchor fascia. A front fascia is fixed to the rafters and also defines a gutter. Roof panels on the rafters are joined along their edges. Each roof panel has a shaped cup edge and an opposite shaped hook edge. The hook of one panel fits into the cup of the adjoining panel. A fastening flange on each cup edge affords means for fixing the panels to the rafters.

Preferably the visible bottoms and sides of the rafters and the beams are covered by decorative sheaths, each being an open channel with means for attachment to the rafters and beams. The beams and related rafters are configured to approximate the nominal sizes of conventional wooden structural members, and the exterior surfaces of the fascia, sheaths and anchor fascia are finished in a wood pattern. Ceiling panels may be inserted into the interstices defined by the crossing rafters and beams. The ceiling panels may support insulation batts below the roof panels.

10 Claims, 7 Drawing Figures

FIG. 3.
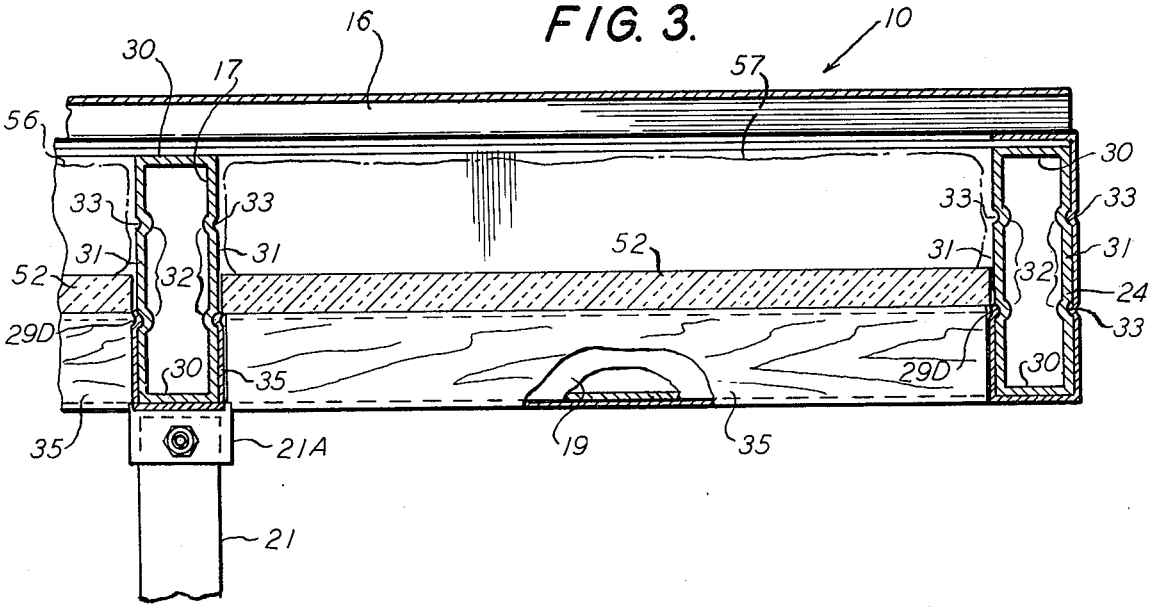
FIG. 4.
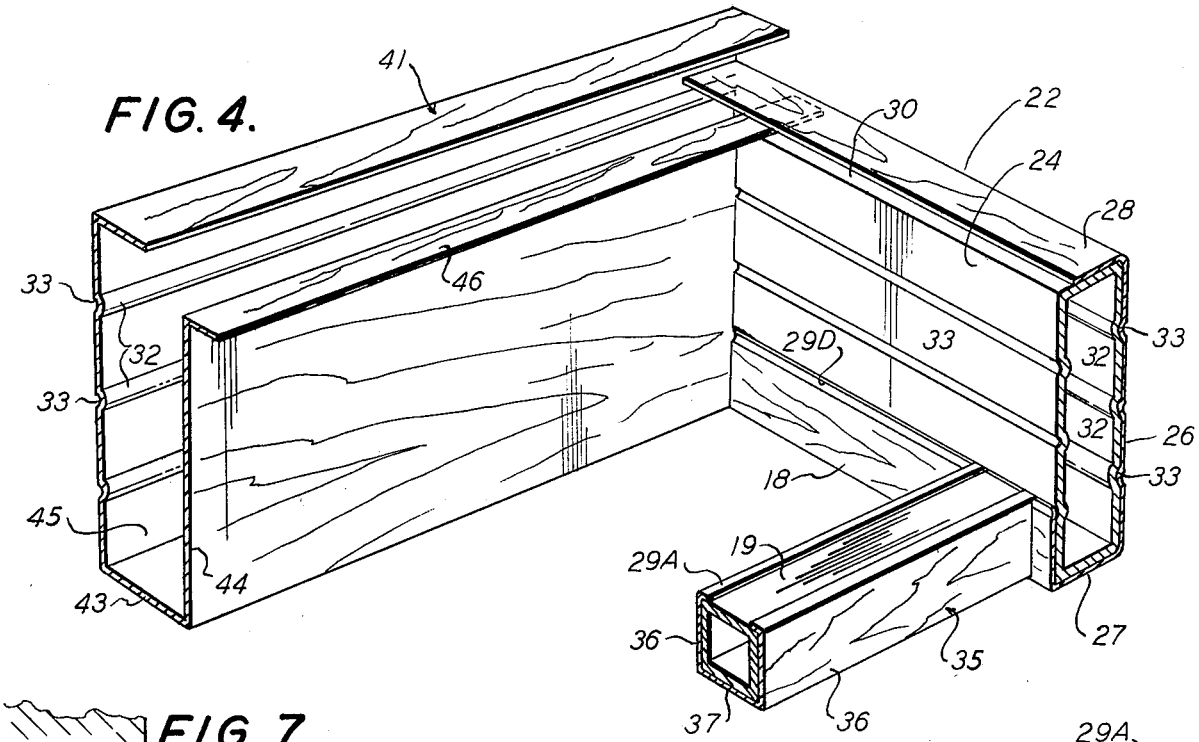
FIG. 7.
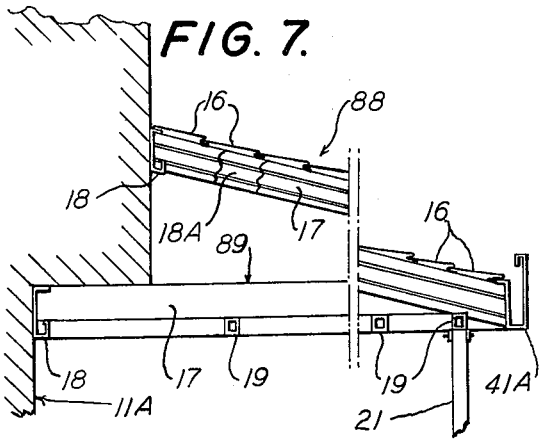
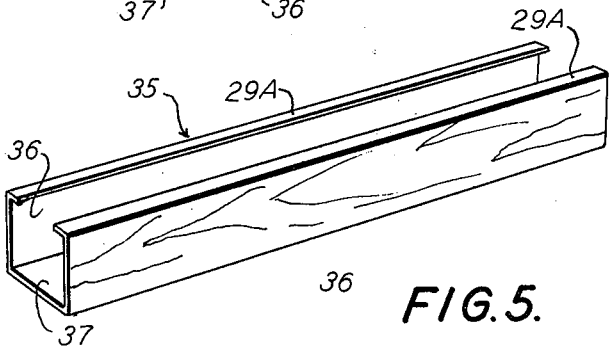
FIG. 5.

SUPPORTED ROOF STRUCTURE

BACKGROUND OF THE INVENTION

The invention relates to lightweight roofs and more particularly to so-called patio and porch roofs that extend from an existing wall to support posts or columns spaced from the wall. While many such roof structures exist, all have problems of rigidity and rain leaks, as well as being expensive to fabricate and install. The instant invention provides a roof structure which is easy to install and fits several structural modes, gives security in winds and rain and can be economically fabricated and assembled on the site.

In addition the structure of the invention is attractive in appearance, and that appearance may be changed, in a short time, if a change is desired. However, if no change is desired, the structure is capable of manufacture from materials of extreme longevity.

SUMMARY OF THE INVENTION

The invention contemplates a roof structure which may be freestanding but which is normally secured to a wall of an existing building and comprises a plurality of hollow box rafters and a plurality of hollow box beams arranged transversely of each other. An anchor fascia which may be fixed to the previous structure wall supports one end of the rafters, while one or more of the beams rest on posts and support the rafters remote from the anchor fascia. A front fascia secured to the rafter ends has bottom and side walls defining a rain gutter across the rafter ends. Side fascia similar to the anchor fascia form side borders for the structure.

Ceiling boards or panels rest upon the beams in the spaces defined by the intersecting rafters and beams. Preferably insulation batts rest upon the upper surfaces of the boards. Roof panels extend across the rafters to form a roof. Each panel has a hook edge and an opposite cup edge. A fastening flange extends from the cup edge, which is covered when panels are joined with the hook edge of one fitted into the cup edge of the next.

Decorative sheaths having a bottom and spaced side walls defining a channel fit over the bottoms of the rafters and the beams. Preferably the outer surfaces of the sheaths are finished in a pleasing aspect such as simulated wood grain, or anodized color.

If it is desired to simulate wood construction in order to harmonize with existing building at the site, the hollow beams and hollow rafters and fascia may be roll-formed or extruded of aluminum or plastic with dimensions matching conventional wood members. To stiffen rolled or extruded members, stiffening ribs are formed in vertical side walls at intervals based on nominal wood sizes.

The structure of the invention can thus be adapted to match existing decor, be changed quickly in appearance, and fabricated with existing materials and conventional techniques. These and other advantages of the invention are apparent from the following detailed description and drawing.

BRIEF DESCRIPTION OF THE DRAWING

FIG. 3 is a fragmentary sectional elevation taken along line 3 — 3 of FIG. 2;

FIG. 4 is a fragmentary perspective view of a front corner of the embodiment of FIG. 1 with the roof panels removed;

FIG. 5 is a perspective view of a decorative sheath;

FIG. 7 is a schematic sectional elevation of an alternate roof structure of the invention.

In the various Figures like parts are identified with like numerals.

DESCRIPTION OF THE PREFERRED EMBODIMENTS

Figure 2:
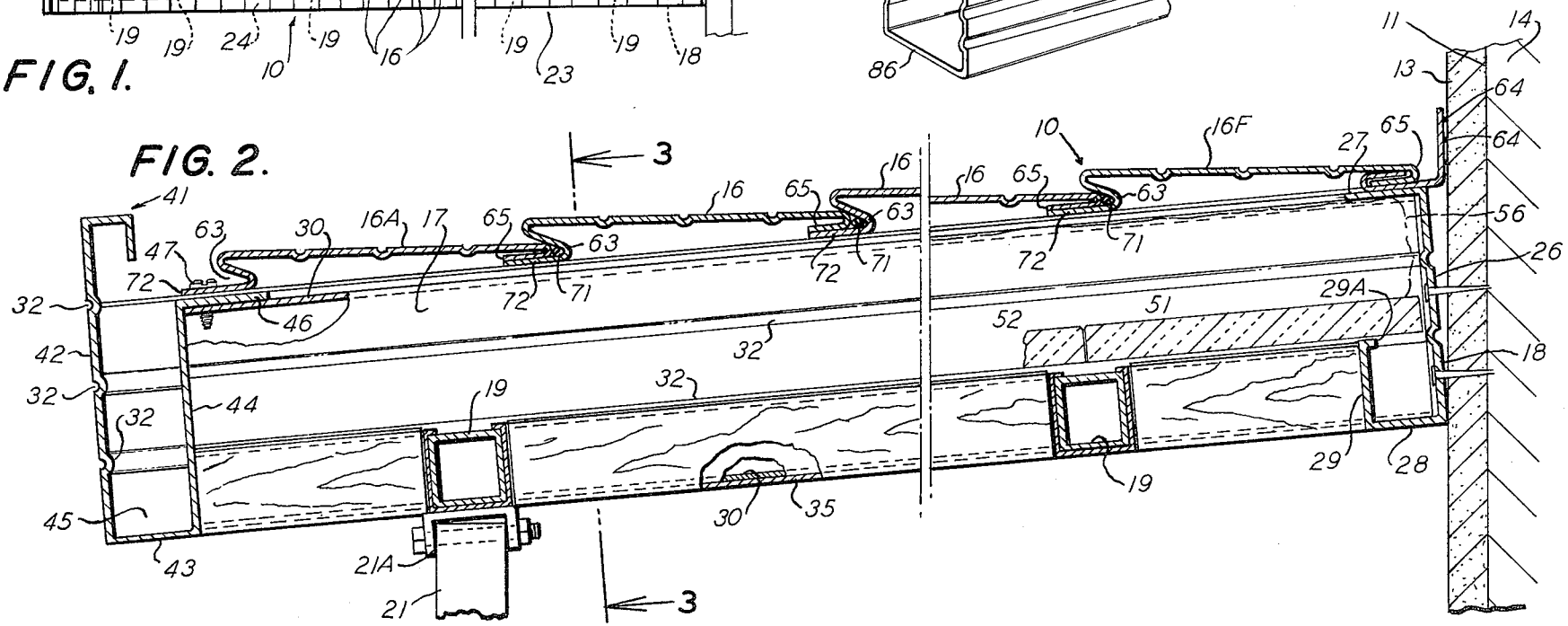
FIG. 2 is a fragmentary sectional elevation taken along line 2 — 2 of FIG. 1.

In FIGS. 1 through 5 a roof structure 10 is shown secured to an existing wall 11 of a building. As seen in FIG. 2, the wall may have an outer layer 13 of plaster, stucco or the like over an inner frame 14. The roof structure comprises roof panels 16 fixed to box rafters 17 which are supported at one end by an anchor fascia 18 nailed or otherwise secured to wall 11. Hollow box beams 19, shown in dotted lines in FIG. 1, extend transversely of the rafters and are secured to the rafters by conventional means, such as rivets, sheet metal screws and the like. A plurality of vertical posts like the post 21 of FIGS. 2 and 3 supports the box beams 19. Channel clips 21A connect the posts to the beams, conventional fasteners being used to secure the clips to the beam bottoms and to the posts.

At the sides 22, 23 of the roof structure fascia strips similar to the anchor fascia 18 may support the edges of the roof panels 16, although the illustrative embodiment employs box rafters 24 for this function. Each fascia 18 comprises a web 26, which is vertical in the views, terminating in upper and lower parallel, spaced flanges 27, 28, respectively. Lower flange 28 is bordered remote from the web by a continuous vertical retainer 29 with an inward lip 29A. As can be seen in FIG. 2, retainer 29 must be notched at intervals to accept the rafters 17, which are supported at their ends on flange 28 of the anchor fascia.

The side fascia (not seen in FIG. 2) would be similarly notched to receive beams 19 at their side terminals, in the alternative embodiment referred to above.

Each box rafter 17, 24, as is best seen in FIGS. 3 and 4, has narrow horizontal faces 30 and deep vertical faces 31, the vertical faces being interrupted at even intervals by ribs 32, which help rigidify the rafters. The intervals between ribs preferably are equal to the standard thickness of dimensional lumber, say 1⅝ inches, so that the roof structure, when surfaced with a wood grained finish, strongly suggests a wooden structure.

The ribs are inwardly convex, thus defining outward grooves 33. The anchor fascia has similar ribs 32, equally spaced, and may thus mesh with those rafters on the outer roof sides 22, 23 as a cover for the rafter. Thus only the fascia and sheaths 35 (see FIG. 5) shown in place on beams 19 and on the rafters 17, 24 in FIGS. 2, 3 and 4 need be decoratively finished.

Each sheath 35 comprises a square channel open on one side and defined by spaced parallel sides 36 extending form the edges of a web 37. Each side terminates away from the web in an inwardly extending lip 29B, similar to the lip on anchor fascia 18 in both appearance and function - meshing with the rib grooves of box rafters 17, 24, or wrapping about the upper corners of beams 19.

An alternate form of fascia and sheath is shown in FIGS. 3 and 4, wherein each meshing lip 29D is arcuate in crosssection, fitting more exactly the contour of the rib groove of the rafter.

The roof structure of the invention has a front fascia 41 which not only trims the appearance of the rafter ends, masking them completely, but also functions to collect run-off from the roof panels. The front fascia comprises an elongate frontal face 42 with parallel strengthening ribs 32. A web 43 at the bottom of the frontal face extends to a wall 44 spaced from the frontal face. The wall, web and frontal face define an elongate trough or gutter 45 that collects run-off from the roof panels.

The wall 44 has continuous horizontal flange 46 on its upper edge extending away from the frontal face and overlapping the upper faces 30 of the rafters. Conventional fasteners 47 are employed to secure the front fascia to the rafters and, preferably, to the adjacent roof panel 16A. Like the side fascia and the sheaths 35 the front fascia may be decorated on its surfaces to match or contrast with the existing structures associated with the roof of the invention.

Depending upon purpose, it may be desired to insulate the roof structure against heat transfer to the covered area. The structure of the invention includes means for securing insulating boards or batts within the structure. Drop ceiling panels may also be combined with the inventive structure.

In FIGS. 2 and 3 insulating boards 51, 52 are shown supported in the roof above the sheathed beams and below the roof panels. Since the rafters define the depth of the structure, the boards or batts must necessarily have less depth than the rafters and the width of individual boards or batts is determined by the rafter spacing. Normally it is desired that the boards like boards 51, 52 that are visible in the lower aspect of the structure comprise an insulating material laminated with an outer "skin" of vinyl or some other like material resistant to weather and pleasing in appearance. Added batts of insulation like batts 56, 57 shown in broken lines in FIGS. 2 and 3 may sulilement the effect of boards 5, 52.

In assembly, the roof structure may be assembled at the site since the rafters, beams and sheaths can be snapped together, with some minimal cutouts in the rafters to bridge the beams, and in the fascia to accept the rafter ends, as heretofore mentioned. The anchor fascia may be nailed or otherwise secured to an existing wall as a starter strip, as shown in FIG. 2, after the anchor fascia flange 29 is notched, and the partly or wholly assembled structure joined to the anchor fascia.

Preferably the first roof panel is not fixed to the rafters near the support wall 11 until a weather strip 61 is fitted with a continuous panel cup 63 on the roof panel edge and meshed therewith. The weather strip is sealed at the wall with one or more beads 64 of caulk extending the width of the strip, which is normally sufficient to fix the strip 61 in place.

Each roof panel 16 is joined to its adjacent panel in like fashion, a return-bent hook 65 of one panel being lodged into the less closed return-bent cup 63 of the adjoining panel. The panels fit well together, but to insure a positive water seal a resilient strip 71 of neoprene or other rubber-like substance is compressed between the continuous curls of the cup and hook of each joined pair of roof panels.

When joined to the rafters, roof panel 16F nearest wall 11 is first secured to the rafters by a sheet metal screw (not shown) like screw 47, put through the extending flange 72 of the panel cup into each rafter. The resilient strip is then inserted and the next panel is thrust hook first into the panel cup against the resilient strip 71. Then that second panel is fixed to the rafters by a plurality of metal screws through its respective flange 72 into the rafters.

While much assembly and sub-assembly may be done at the site of fabrication, such steps as cutting the sheaths to length and notching the sheaths and fascia to take the post clips 21A and the rafters, is best done at the installation site.

With careful attention to detail the roof structure of the invention affords a structure which may be quickly installed, matched or otherwise fitted to the decor of the installation site, and afford a heat insulated protection to a selected area.

Figure 1:
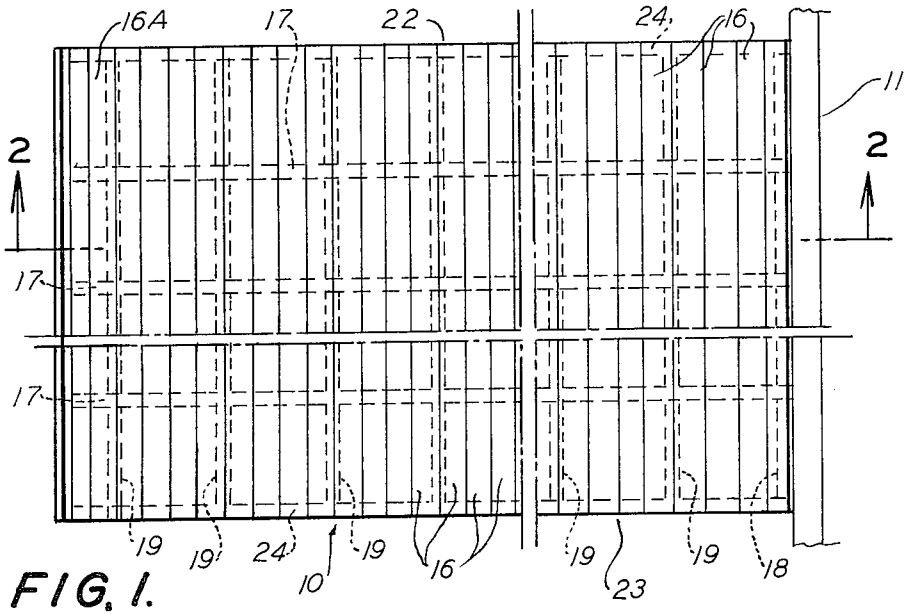
FIG. 1 is a fragmentary plan view of a roof structure in accordance with the invention.
Figure 6:
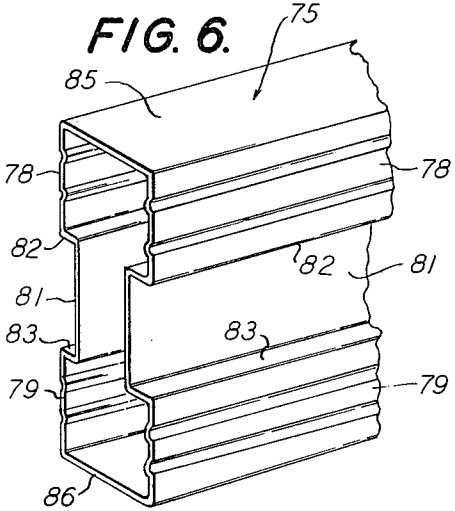
FIG. 6 is a fragmentary perspective view of an alternate rafter in accordance with the invention.

While some modifications in elements have been suggested thus far in this specification, FIGS. 6 and 7 specifically illustrate others. For instance, in FIG. 6 a box rafter 75 has a depth equal to three units of conventional dimensional lumber thickness. The units are each defined in the embodiment of FIG. 6 by the structure in which ribbed side areas 78, 79 on each face of rafter 75 are separated by a recessed un-ribbed face area 81. In addition to accentuating the three areas of the face, the recessed face area affords shoulders 82, 83 on both sides of the rafter between which insulation boards or other dropped ceiling panels may be secured. The rafter of FIG. 6 is also resistant to torque because of the combination of shallow and deep ribs which define its three sections. Horizontal faces 85, 86 similar to those faces of previously described rafters close the box of the rafter, which may, with minor modifications, be either roll-formed or extruded.

FIG. 7 shows another embodiment of the invention in which the roof structure comprises two levels, 88 and 89, both extending from a front fascia 41A similar to that fascia previously described. Again, posts like post 21 support beams 19 across which rafters extend to a wall 11A to which an anchor fascia 18 is secured. This lower structure of beams and rafters may support drop-in ceiling or insulating panels (not shown), or the insulation may be secured in the upper structure defined by rafters 17 and roof panels 16 fixed to the rafters as previously set forth with respect to the embodiment of FIG. 1.

The structure of FIG. 7 may have side fascia like fascia 18A similar to the anchor fascia 18 in its elements, but differing in purpose in the combination. In the instance of the FIG. 7 embodiment the fascia 18A may be used as perimeter rafters, outboard on each side of the rafters 17 supported directly by support posts 21.

While the foregoing specification has set forth several embodiments of the invention, other modifications within the scope of the invention will occur to those skilled in the art. It is therefore desired that the invention herein be measured by the appended claims rather than by the illustrative disclosure set forth herein.

I claim:

1. A roof structure to extend from a wall and supported on columns and comprising a plurality of hollow box rafters, a plurality of hollow box beams interstices, decorative sheaths on adjacent surfaces of both beams and rafters, a fascia box across a plurality of rafter ends, said fascia box having a decorative outer surface and walls defining a run-off gutter, an anchor fascia at the opposite ends of the rafters and adapted to be fixed to the wall for supporting the rafters, a turned channel on the anchor fascia adapted to receive rafter ends, a decorative outer surface on the anchor fascia, drop-in ceiling boards in the interstices defined by the rafters and the beams and supported by said beams, and roof panels lying transversely of the rafters having a continuous upper hook and a continuous lower cup adapted to receive the upper hook on each roof panel, and a fastening flange extending from the lower cup of each panel.

2. Roof structure in accordance with claim 1 further comprising side fascia of decorative aspect extending between the front fascia and the anchor fascia below the roof panels.

3. Roof structure in accordance with claim 2 wherein the side fascia comprises a sheath adapted to snap about a rafter on at least three sides thereof.

4. Roof structure in accordance with claim 1 further comprising stiffening ribs on vertical faces of rafters and of fascia, said ribs being vertically spaced an increment equal to the width of the rafter and of the fascia.

5. Roof structure in accordance with claim 4 wherein each decorative sheath comprises a bottom wall; parallel, spaced side walls, and terminal ribs on each side wall adapted to fit with said stiffening ribs.

6. Roof structure in accordance with claim 5 wherein said stiffening ribs and said terminal ribs are inwardly convex.

7. Roof structure in accordance with claim 1 wherein said rafters and said beams are rolled hollow boxes.

8. Roof structure in accordance with claim 1 wherein said rafters and said beams and said fascia are extruded forms.

9. Roof structure in accordance with claim 1 wherein said front fascia comprises a front face, an upper flange at right angles to the face, a depending lip on the flange, a bottom wall and an upright wall defining a gutter channel, and an extending flange on the upright wall adapted to attach to said rafters.

10. Roof structure in accordance with claim 9 further comprising stiffening ribs on the front face coextensive with the run of the front fascia.

* * * * *